US005369812A

United States Patent [19]

Trombley

[11] Patent Number: 5,369,812

[45] Date of Patent: * Dec. 6, 1994

[54] TOILET VENTILATION ASSEMBLY INCLUDING FLUID EXTRACTION DEVICE

[76] Inventor: Ronald W. Trombley, P.O. Box 296, Igo, Calif. 96047

[ * ] Notice: The portion of the term of this patent subsequent to Nov. 9, 2010 has been disclaimed.

[21] Appl. No.: 96,434

[22] Filed: Jul. 26, 1993

Related U.S. Application Data

[62] Division of Ser. No. 840,305, Feb. 24, 1992, Pat. No. 5,259,072.

[51] Int. Cl.[5] ..... E03D 9/04; E03D 9/052

[52] U.S. Cl. ..... 4/213; 4/217; 4/347

[58] Field of Search ..... 4/213, 214, 238, 251.1, 4/347, 348, 349, 350, 351, 352, 217

[56] References Cited

U.S. PATENT DOCUMENTS

| | | | |
|---|---|---|---|
| 2,696,619 | 12/1954 | Ring | 4/341 |
| 3,277,499 | 10/1966 | Keefauver . | |
| 3,824,637 | 7/1974 | Hunnicutt, Jr. | 4/348 |
| 4,017,916 | 4/1977 | Pearson | 4/347 |
| 4,031,574 | 6/1977 | Werner | 4/347 |
| 4,103,370 | 8/1978 | Arnold | 4/216 |
| 4,318,192 | 3/1982 | Williams et al. | 4/349 |
| 4,365,361 | 12/1982 | Sanstrom . | |
| 4,726,078 | 2/1988 | Carballo et al. | 4/347 |
| 5,016,294 | 5/1991 | Canovas | 4/347 |

FOREIGN PATENT DOCUMENTS

| | | | |
|---|---|---|---|
| 995625 | 12/1951 | France . | |
| 2237825 | 5/1991 | United Kingdom | 4/349 |

*Primary Examiner*—Henry J. Recla
*Assistant Examiner*—Charles R. Eloshway
*Attorney, Agent, or Firm*—Flehr, Hohbach, Test, Albritton & Herbert

[57] ABSTRACT

A toilet ventilation apparatus (40) for extracting air (13) proximate a toilet assembly (10). The toilet ventilation apparatus (40) comprises an air intake mechanism (42) positioned for use proximate a rim (30) of a toilet bowl (12) for intaking air proximate an opening (20) into the toilet bowl (12) of the toilet assembly (10). An air extraction fan (72) is coupled to the air intake mechanism (42) for extracting air (13). A fluid removal mechanism (46) integrally coupled to the air intake mechanism (42) substantially removes trapped fluid (15) undesirably collected by the intake mechanism (42) during air extraction. The fluid removal mechanism (46) comprises a plurality of fluid collection troughs (66) communicably coupled to a plurality of intake apertures (56) situated about the intake mechanism (42). An actuating mechanism (100) is operably coupled to the air extracting fan (72) for automatically controlling the operation of the ventilation apparatus (40).

24 Claims, 3 Drawing Sheets

TOILET VENTILATION ASSEMBLY INCLUDING FLUID EXTRACTION DEVICE

This is a division of application Ser. No. 07/840 305 filed Feb. 24, 1992, now U.S. Pat. No. 5,259,072.

TECHNICAL FIELD

The present invention relates, generally, to ventilation assemblies and, more particularly, to ventilation assemblies for toilets.

BACKGROUND OF THE ART

The odors emanating from a toilet may linger some time before being extracted from the bathroom by a room exhaust fan or through natural airflow. Typically, room exhaust fans are mounted to either the wall or the ceiling of a bathroom, and they redirect this malodorous air out of the room and building. Usually, these fans are positioned too far from the source to immediately remove the offending air. These odors may fully diffuse throughout the bathroom and beyond before being drawn out through the exhaust fan.

Strategic placement of the bathroom exhaust fan can be beneficial in many applications. Too often, though, positioning of the fan is dictated by structural limitations which may or may not limit effectiveness. Moreover, even though placement may be closer to the toilet, the fans are sometimes too small or too underpowered to be entirely effective. Thus, undesirable permeation of the malodorous air still presents a problem.

Attempts have been made to alleviate this problem by mounting a venting device directly to the toilet assembly. Generally, these devices position a ventilation intake duct near the back portion of the toilet bowl. This intake duct is coupled, by flexible piping, to an exhaust fan mounted proximate the toilet which vents the air to a generally exterior location outside the structure.

Typical of prior art toilet ventilation devices are the devices disclosed in U.S. Pat. Nos. 4,365,361 to Sanstrom and 3,277,499 to Keefauver, each of which describes a ventilation device having an intake duct positioned near the toilet bowl and a remote fan coupled to the intake duct by flexible piping.

While these ventilation devices have been effective in removing toilet odors, such an approach becomes problematic when water, urine, water vapor or the combination thereof enter the intake ducts and thereafter reach the exhaust fan. In particular, when the toilet is flushed, the swirling action or the impingement of the reservoir water against the toilet bowl often spatters the water which collects in the intake vents. Accordingly, the suction of the exhaust fan draws the water or water vapor through the piping where it collides with the exhaust fan. This causes premature wear and deteriorates the bearings and other components of the fan. Reliability of such ventilation systems, therefore, is often decreased while maintenance costs are increased.

Another problem associated with the above-mentioned toilet ventilation systems is that the actuation device for activating the fan is often positioned proximate the toilet seat or toilet bowl. For example, these devices generally include mechanical switches positioned in or near the pivotal seat which activates the fan when the user sits down on the seat. These activation devices run the risk of electrically shorting when contacted with water. Furthermore, spattered water may deteriorate the switch itself. More importantly, these activation mechanisms present potential electrical hazards because their power source is often the household 110 VAC.

Still other problems persist with prior toilet ventilation systems. They generally cannot be retrofit to existing toilets without substantial modification or integration. Often replacement or removal of the toilet seat or bowl is necessary so that the device may be installed. The assembly of the Keefauver patent, for example, requires replacement of the toilet seat with a special one incorporating resilient bumpers which prevent transmission of any twisting stresses on the intake duct housing. The Sanstrom assembly, on the other hand, requires removal of the toilet bowl so that it may be mounted to a special platform which allows the exhausted air to be directed down the flushing drain.

Accordingly, it is an object of the present invention to provide a toilet ventilation apparatus which removes malodorous air originating from toilet.

It is another object of the present invention to provide a toilet ventilation apparatus which substantially removes fluids from the air intake to prevent the fluids from contacting the exhaust fan.

Still another object of the present invention is to provide a toilet ventilation apparatus which increases the reliability and life expectancy of the air extraction device.

Yet another object of the present invention to provide a toilet ventilation apparatus which can be easily retrofit to existing toilets with minimal effort.

It is another object of the present invention to provide a toilet ventilation apparatus which reduces submission to electrical hazards.

It is a further object of the present invention to provide an optical analyzing apparatus and method which is durable, compact, easy to maintain, has a minimum number of components, is easy to use by unskilled personnel, and is economical to manufacture.

The apparatus and method of the present invention has other objects and features of advantage which will be more readily apparent from the following description of the Best Mode of Carrying Out the Invention and the appended claims, when taken in conjunction with the accompanying drawing.

DISCLOSURE OF THE INVENTION

The present invention includes a toilet ventilation apparatus for mounting to a toilet assembly including a bowl having a rim which defines an opening to an interior cavity of the bowl. The toilet ventilation apparatus comprises an air intake structure formed for mounting proximate the rim for exhausting air from a volume proximate the opening. An air extraction mechanism is coupled to the air intake structure for extracting air. A fluid removal structure is provided in the air intake structure for removing fluid entering the intake. The fluid removal structure preferably comprises at least one fluid collection trough mounted proximate to a plurality of intake apertures situated about the intake structure.

In an alternative embodiment of the present invention, an actuating mechanism is operably coupled to the air extracting mechanism for automatically controlling the operation of the ventilation assembly.

These and other features and advantages of the present invention will become more apparent from the following description of exemplary embodiment thereof, as illustrated in the accompanying drawing.

BEST MODE OF CARRYING OUT THE INVENTION

The toilet ventilation apparatus of the present invention employs a fluid removal device which removes a significant proportion of the fluids and fluid vapor entering the ventilation intake before they can reach the ventilation fan. The following description is presented to enable a person skilled in the art to make and use the invention, and is provided in the context of a particular application and its requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, buts to be accorded with the widest scope consistent with the principles and features disclosed herein.

Figure 1:
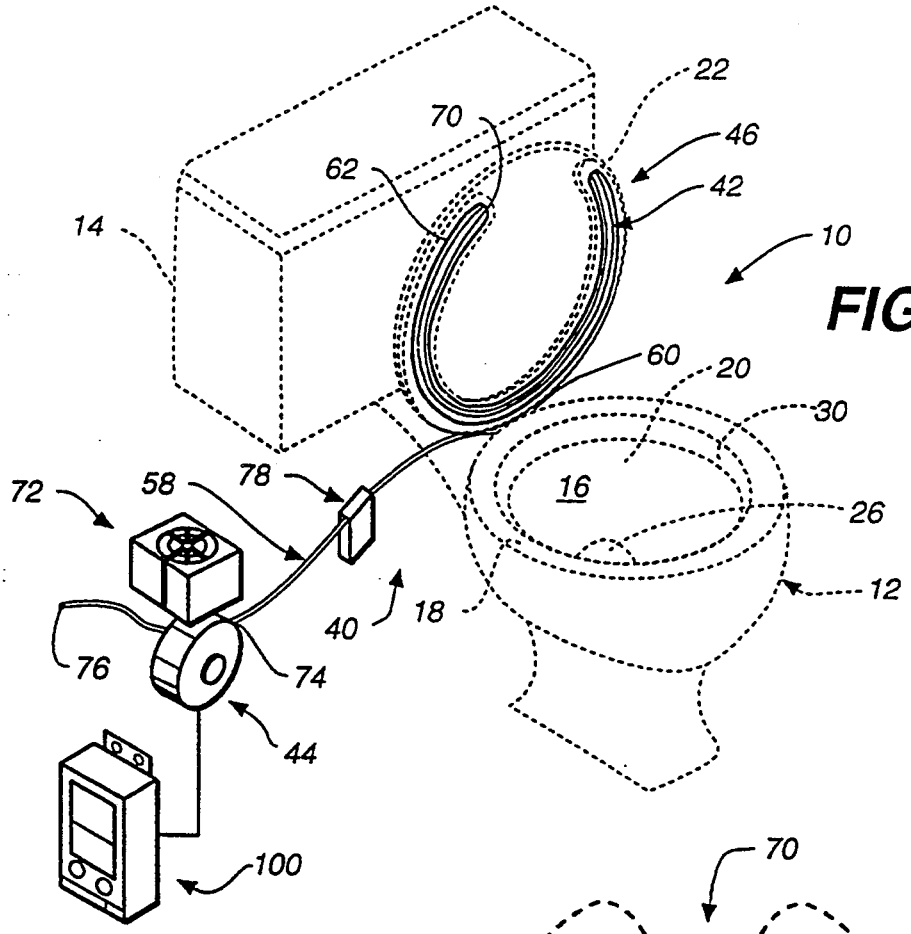
FIG. 1 is a top perspective view of a ventilation apparatus constructed in accordance with the present invention and mounted to a toilet assembly, shown in broken lines.

It will be noted here that for a better understanding, like components are designated by like reference numerals throughout the various figures. Attention is now directed to FIG. 1, where the subject toilet ventilation apparatus, generally designated 40, is illustrated. In accordance with the present invention, ventilation apparatus 40, briefly, comprises an air intake means, generally designated 42, positioned proximate a toilet bowl 12 of toilet assembly 10, and an air extraction means, generally designated 44, coupled thereto and capable of exhausting air from a volume proximate bowl opening 20 through intake means 42 for discharge at a remote location. A fluid removal means, generally designated 46, is provided in air intake means 42 for removing fluids, generally designated 15, (shown in FIG. 3) undesirably drawn into air intake means 42 during air intake.

Although the present invention may be adapted to other uses, ventilation apparatus 40 is particularly suitable for mounting to a conventional toilet assembly. Generally, toilet assembly 10 includes a water reservoir tank 14 which stores water (not shown) therein, and a toilet bowl 12 communicably coupled to tank 14. Bowl 12 includes a cavity 16 and an upwardly facing rim portion 18 which defines an opening 20 to cavity 16. Positioned atop rim portion 18 of bowl 12 is a pivotal, substantially annular, toilet seat 22 which is movable between an "up" position and a "down" position. Cavity 16 is dimensioned to retain a body of water 24 (FIG. 2), which is to be flushed with waste products from cavity 16 through a cavity exit port 26 when water from tank 14, either gravitationally or through pressure, enters bowl 12.

Figure 4:
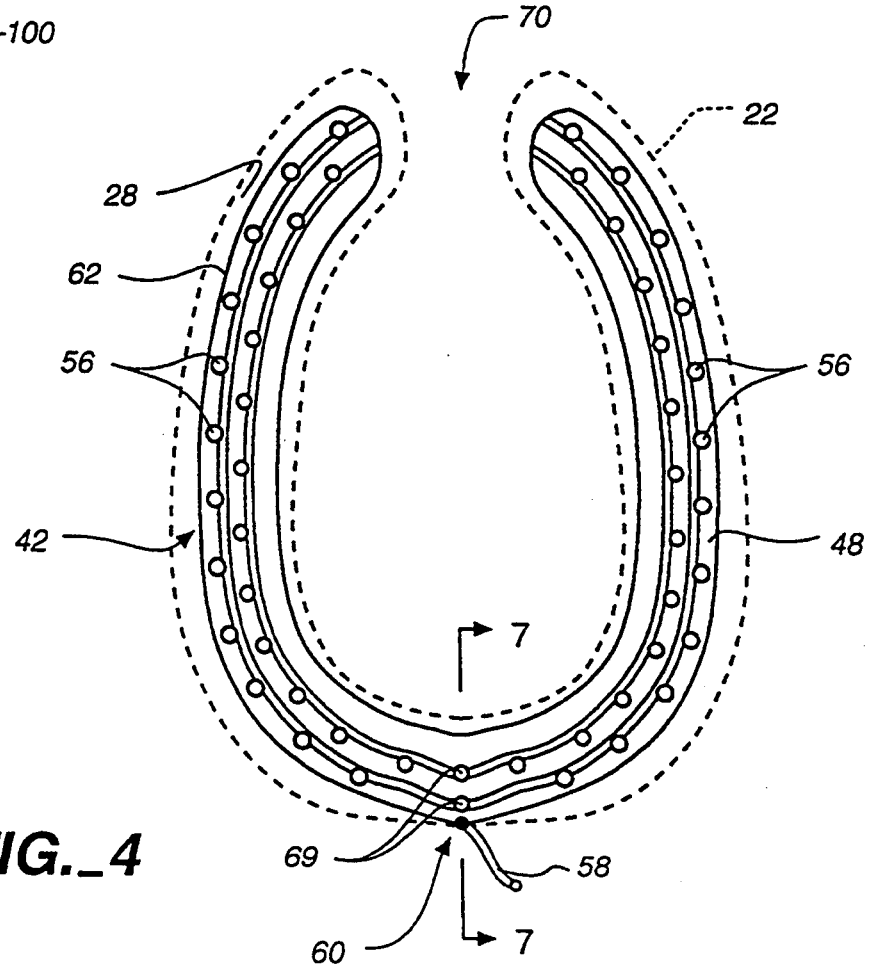
FIG. 4 is an enlarged bottom plan view of the toilet seat of the toilet assembly of FIG. 1 showing the air intake and fluid removal device mounted thereon.
Figure 2:
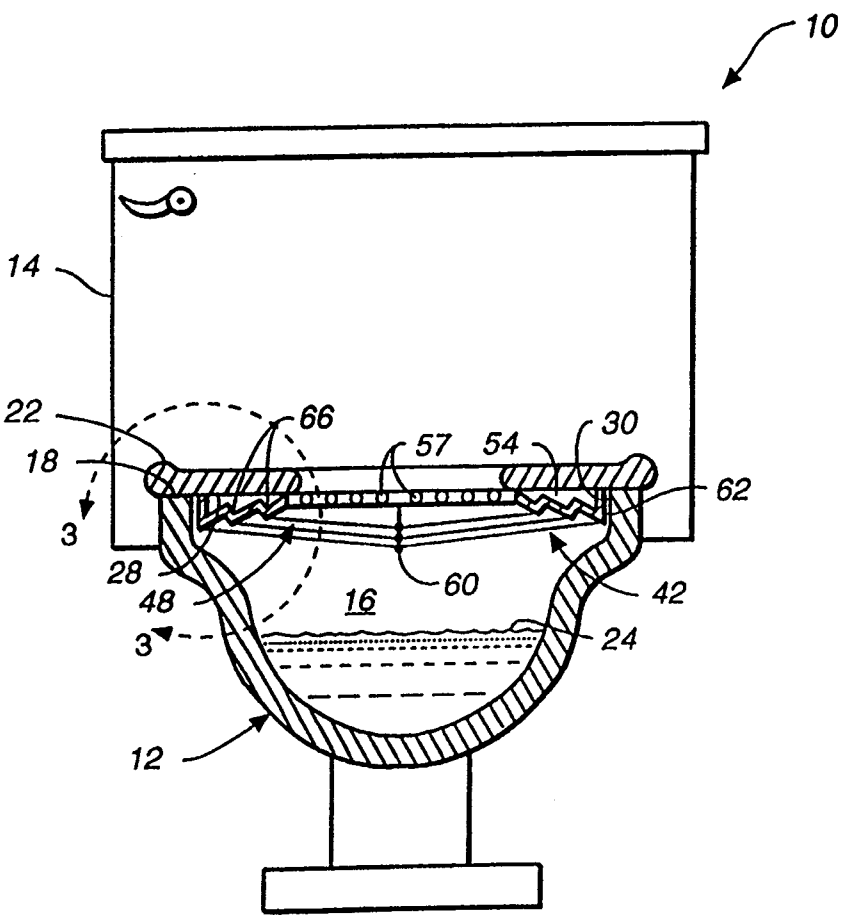
FIG. 2 is a front elevation view, in partial cross-section, of the toilet assembly of FIG. 1 illustrating the air intake and fluid removal devices of the present invention.
Figure 3:
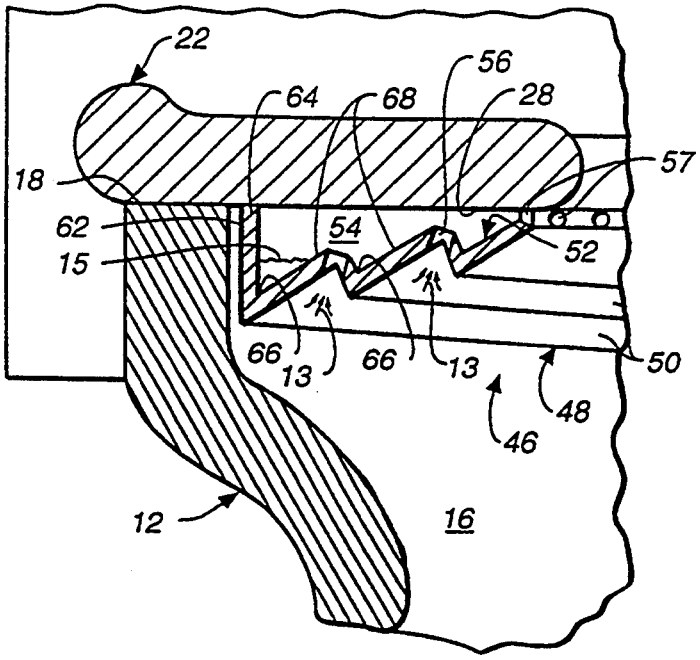
FIG. 3 is an enlarged, fragmentary front elevation view of the area bounded by line 3—3 of FIG. 2.

Turning now to FIGS. 2–4, ventilation apparatus 40 of the present invention will be described in greater detail. As shown in FIG. 4, air intake means 42 preferably is a generally U-shaped device 42 dimensioned to mount to an underside surface 28 of toilet seat 22. It will be appreciated that intake device 42 could comprise a complete ring when ring-shaped toilet seats are employed. FIG. 3 illustrates that air intake device 42 includes a wall 48 having an exterior surface 50, which faces cavity 16, and an interior surface 52 which defines an internal chamber 54. A plurality of intake apertures 56 and 57 extend from exterior surface 50 to interior surface 52 and chamber 54. Briefly, chamber 54 is communicably coupled to air extraction means 44 through conduit means or flexible tubing 58 extending therebetween, as best viewed in FIG. 1. Tubing 58, shown in FIG. 5, extends from a rear portion 60 of air intake device 42 to exhaust or extraction means 44. Accordingly, when extraction means 44 is operated, air in and around opening 20 and cavity 16 is drawn in through intake apertures 56 and 57 (FIG. 4) into chamber 54 (FIG. 3), as indicated by arrows 13 in FIG. 3, and out of chamber 54 through tubing 58 to extraction means 44. Apertures 57 are especially effective since they face directly into opening 20.

In the preferred form, as shown in FIG. 1, ventilation apparatus 40 is designed to retrofit to most toilet bowl-type assemblies using only minimal effort. In contrast, the prior art often required substantial replacement of existing parts or removal of the whole toilet assembly. In accordance with the present invention, U-shaped air intake device 42 is dimensioned to be positioned proximate bowl opening 20. An outer perimeter 62 of air intake device 42 is shaped substantially similarly to an inner perimeter 30 of rim portion 18 which defines opening 20. As shown in FIGS. 1 and 2, mounting of air intake device 42 to seat 22 does not interfere with the normal operation and use of toilet assembly 10. Moreover, when seat 22 is raised to the "up" position, air intake device 42 is completely removed from opening 20. It will be appreciated, however, that device 42 could just as easily be mounted directly to rim portion 18 so that intake assembly 42 is always positioned proximate the inner perimeter 30 of rim 18.

When air intake device 42 is mounted to underside surface 28 of seat 22, as shown in FIG. 3, seat surface 28 may be used as part of the enclosure wall which encloses and defines chamber 54. Upwardly facing edges 64 of wall 48 are suitably formed to sit flush against underside seat surface 28 so that seat surface 28 forms an enclosure wall oppositely facing intake apertures 56. Wall 48 of intake device 42, however, may just as easily extend fully around chamber 54 to enclose it thereof. Regardless, exhausted air is drawn through intake apertures 56 and 57 to chamber 54. Air intake device 42 may be mounted to seat 22 through conventional mounting means such as fasteners or adhesives.

In accordance with the present invention and as best shown in FIG. 3, fluid removal means 46 comprise a plurality of adjacent, concentric troughs 66 defined by interior surface 52 of the intake means. Troughs 66 extend circumferentially around intake device 42. Troughs 66 are formed to direct trapped fluids 15 out of chamber 54 so that they do not reach air exhaust or extraction means 44 (FIG. 1). Adjacent troughs 66 include slanted faces 68 which constitute a portion of interior surface 52. Slanted faces 68 line and define one surface of troughs 66, and are sufficiently inclined to cause gravitation of fluids 15 trapped in chamber 54 from apertures 56 and 57 to the apex of troughs 66. In the preferred embodiment, fluid removal means 46 includes between 2–5 side-by-side troughs 66.

Figure 5:
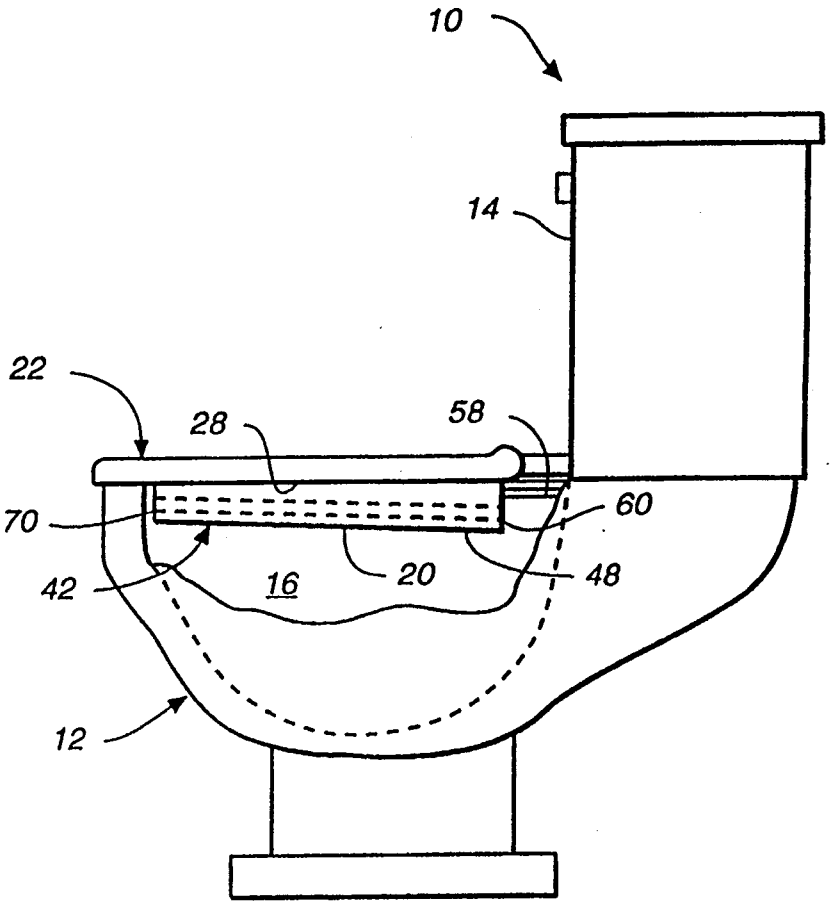
FIG. 5 is a side elevation view, partially broken away, of the toilet assembly of FIG. 1 illustrating the inclination of the air intake and fluid removal devices of the present invention.

To facilitate gravitational flow to exit apertures 69, troughs 66 are inclined downward from a front portion 70 of intake device 42 to rear portion 60, as shown in FIG. 5. Accordingly, trapped fluids 15 entering intake apertures 56 and 57 collect and trickle down slanted faces 68 into adjacent troughs 66. Subsequently, downwardly inclined troughs 66 gravitationally expedite rearward flow toward rear portion 60 of intake device 42 until fluid 15 is deposited back into bowl 12 through exit apertures 69. In comparison, the prior art assemblies allowed trapped fluids 15 to flow directly to extraction device 44 (FIG. 1).

Figure 7:
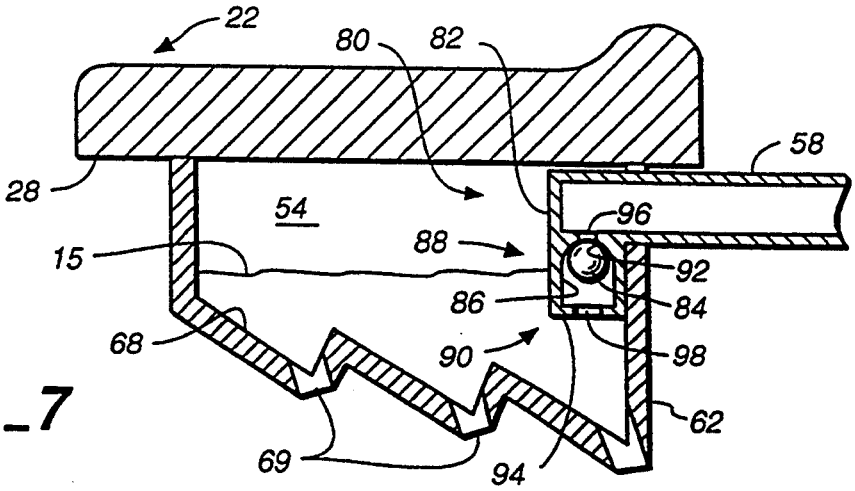
FIG. 7 is an enlarged, fragmentary front elevation view, in cross-section, of the area bounded by line 7—7 of FIG. 4 illustrating an alternative embodiment of the present invention incorporating an air ball float device.

Tube 58 extends from an upper portion of outer perimeter 62, as shown in FIG. 5, which is a sufficient distance from exit apertures 68 so that intake air is drawn in substantially through apertures 56 and 57 rather than substantially through exit apertures 69. In an alternative embodiment, tube 58 may include an air ball float device 80, which further prevents liquids from entering tube 58. As best shown in FIG. 7, one end portion 82 of tube 58 communicably coupled to chamber 54 is positioned at a substantial vertical orientation. A buoyant air ball 84 is movably positioned inside tube end portion 82 and can move up and down therein. Air ball 84 has a diameter slightly smaller than the diameter of the inner perimeter wall 86 of tube end portion 82 such that air may flow therebetween and ball 84 can move freely through tube 58.

Float device 80 further includes an upper ball stop 88 and a lower ball stop 90 which limits the travel of air ball 84 through end portion 82. Upper ball stop 88 and lower ball stop 90 each includes a shoulder portion 92 and 94, respectively, extending radially inward from inner perimeter wall 86 which is formed to prevent the passage of air ball 84 and to seal tube 58 from chamber 54. Shoulder portions 92 and 94 define upper opening 96 and lower opening 98, respectively, which are sufficiently dimensioned to prevent the passage of air ball 84. However, intake air may easily flow therethrough.

Air ball 84 is gravity bias to seat against lower shoulder portion 94 in order to close off lower opening 96 when air is not being drawn through tube 58. However, activation of extraction device 44 will slightly lift and unseat air ball 84 from lower shoulder 94 so that air may be drawn through tube 58. Similarly, should liquid 15 collect in chamber 54 at such a rate and to such a quantity which greatly exceeds exit apertures 69 dispensing capacity, float device 80 prevents liquid 15 from entering tube 58. As best viewed in FIG. 7, as the level of liquid 15 rises in chamber 54, liquid 15 urges air ball 84 against upper shoulder 92 which substantially prevents the passage of liquid 15 through upper opening 96.

Figure 6:
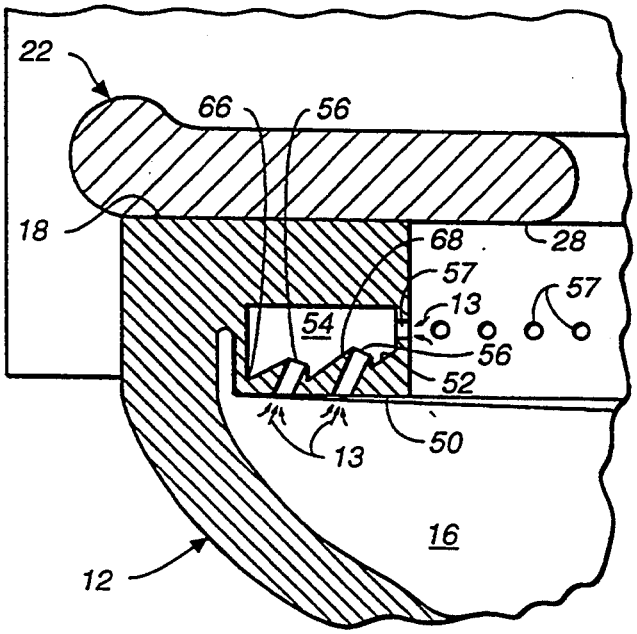
FIG. 6 is an enlarged, fragmentary, front elevation view, in cross-section, corresponding to FIG. 3, of the air intake and fluid removal devices of the present invention integrally formed with the rim portion of the toilet assembly.

As shown in FIG. 4, intake device 42 is preferably formed of plastic or the like which is lightweight and deformable. However, air intake device 42 could also be composed wood, metal or other suitable material without departing from the invention. Alternatively, as illustrated in FIG. 6, air intake device 42 and fluid removal troughs 66 could be integrally formed into rim portion 18 of toilet bowl 12. This, of course, is functionally equivalent to the retrofit version, but would require a more substantially modification to the existing toilet assembly 10, if not complete replacement of bowl 12. It also would be possible to mount a retrofit version to bowl rim 18 rather than seat 22, or to manufacture it directly into toilet assembly 10 (FIG. 6), as will be described below.

Extraction or air exhaust device 44 may be provided by virtually any air displacement device, such as an mechanical or electric fan, or an air extraction pump. Preferably, air extraction device 44 is a simple, conventional electric fan 72, as shown in FIG. 1, which may be placed at a location remote from toilet assembly 10. Such placement substantially reduces the occurrence of electrical shock from electric fan assembly 72. Fan assembly 72 includes a fan intake 74 and a fan outlet 76. Fan intake 74 is coupled to flexible tubing 58 while fan outlet 76 is coupled to an air vent (not shown) which directs exhausted or extracted air to a remote location. Therefore, the bathroom occupant will not be subject to the malodorous extracted air.

In an alternative embodiment, an in-line moisture trap 78 is mounted intermediate flexible tubing 58 between air intake device 42 and air extraction device 44. Moisture trap 78 is formed to substantially extract fluid vapors from flexible tubing 58, which is preferably ¾ to one inch in diameter, before it reaches electric fan 72 and causes premature wear. Fluid removal troughs 66 are sufficient for collecting and removing liquids which are not entrained in the intake air; however, liquids in the form of vapor entrained in the air may not precipitate and be removed by fluid removal troughs 66. Accordingly, undesirable liquid vapor is collected and removed by in-line moisture trap 78, which is preferably a Positive Ventilation Control (PVC) valve, air compressor trap or the like which is capable of removing moisture from air.

In still another alternative embodiment, an automatic actuation device 100, as shown in FIG. 1, may be electrically connected to air extraction device 44 to effect automatic actuation of ventilation apparatus 40. In this embodiment, actuation device 100 is preferably an infrared sensing device, well known in the art, which is capable of sensing movement. Infrared detector 100 may be positioned such that when a bathroom occupant enters the room or is situated proximate toilet assembly 10, extraction fan 72 will be actuated to draw air through intake device 42. Thus, infrared detector 100 is preferably mounted to a wall of the room where the infrared beam can detect movement. Moreover, actuation device 100 may incorporate many option such as a day/night sensor, an adjustable timer and/or a manual override.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims.

Therefore, persons of ordinary skill in this field are to understand that all such equivalent structures are to be included within the scope of the following claims.

What is claimed is:

1. A toilet ventilation apparatus for mounting to a toilet assembly including a bowl having a rim which defines an opening to an interior of said bowl, said toilet ventilation apparatus comprising:

air intake means for exhausting air from a volume proximate said opening including a wall defining a chamber and having a plurality of intake apertures extending through said wall and into said chamber, said air intake means being mounted to said rim such that said wall is positioned along an inner perimeter of said rim;

air extraction means coupled to said air intake means drawing in air through said air intake means; and fluid removal means provided in said air intake means for removing fluid entering said air intake means, said fluid removal means including a trough defined by said wall and having a slanted face positioned between said trough and each said aperture, said slanted face being sufficiently inclined downwardly toward said trough to cause said fluid entering said apertures to gravitate toward said trough for collective removal thereof.

2. The toilet ventilation apparatus as defined in claim wherein, said fluid removal means is formed to provide a plurality of separate, similarly formed fluid collection troughs positioned in a side-by-side substantially concentric relation, each said trough having a slanted face sufficiently inclined downwardly toward said respective trough and away from respective intake apertures .

3. The toilet ventilation apparatus as defined in claim 2 wherein, the plurality of side-by-side troughs define a plurality of apexes therebetween, said plurality of intake apertures being positioned in a spaced relation along said plurality of apexes.

4. The toilet ventilation apparatus as defined in claim 3 wherein, said fluid removal means include a plurality of exit apertures communicating between said collection troughs and said bowl for depositing collected fluid back into said bowl.

5. The toilet ventilation apparatus as defined in claim 4 wherein, each said collection trough is inclined downward toward respective exit apertures.

6. The toilet ventilation apparatus as defined in claim 5 further including:

an in-line moisture trap positioned between said air intake means and said air extraction means.

7. The toilet ventilation apparatus as defined in claim 6 wherein, said moisture trap comprises a Positive Ventilation Control (PVC) valve.

8. The toilet ventilation apparatus as defined in claim 1 further including:

an in-line moisture trap positioned between said air intake means and said air extraction means.

9. The toilet ventilation apparatus as defined in claim 8 wherein, said moisture trap is a Positive Ventilation Control (PVC) valve.

10. The toilet ventilation apparatus as defined in claim 1 wherein, said air extraction means comprises an electric fan.

11. The ventilation apparatus as defined in claim 10 wherein, said air extraction means includes conduit means coupled to said electric fan which directs said air to a remote area.

12. The toilet ventilation apparatus as defined in claim 1 wherein, said air extraction means comprises an air extraction pump.

13. The toilet ventilation apparatus as defined in claim 1 wherein, said air intake means is shaped substantially similar to the inner perimeter of said rim defining said opening.

14. The toilet ventilation apparatus as defined in claim 1 wherein, said air intake means is integrally formed in said bowl.

15. The toilet ventilation apparatus as defined in claim 1 further including:

actuating means operably coupled to said air extraction means for activating said ventilation apparatus.

16. The toilet ventilation apparatus as defined in claim 15 wherein, said actuating means comprises an infrared detector responsive to movement of a user.

17. The toilet ventilation apparatus as defined in claim 15 wherein, said actuating means comprises a mechanical switch operable between an on position and an off position.

18. The toilet ventilation apparatus as defined in claim 15 wherein, said actuating means includes an automatic timer responsive to activation of said ventilating apparatus to automatically shut off said extraction means after a predetermined period of time from said activation.

19. The toilet ventilation apparatus as defined in claim 18 wherein, said predetermined period of time ranges between about 15 seconds to about 15 minutes.

20. The toilet ventilation apparatus as defined in claim 1 further including:

a member formed with a vertically extending passageway therethrough, said passageway terminating in said chamber at a first opening at one end thereof, and said passageway communicably coupled to said air extraction means through a second opening at an opposing end thereof; and a buoyant member positioned in said passageway and movable between said first opening and said second opening, said buoyant member being formed to substantially block said second opening upon filling of said chamber with liquid to a level proximate said second opening.

21. The toilet ventilation apparatus as defined in claim 20 wherein, said second opening is defined by an annular shoulder portion protruding radially inwardly into said passageway from a wall defining said passageway.

22. The toilet ventilation apparatus as defined in claim 21 wherein, said buoyant member is spherical.

23. In a toilet ventilation apparatus for use with a toilet assembly having a fluid bowl with a rim defining an upwardly facing opening, and a pivotal toilet seat mounted over said rim, said ventilation apparatus including air intake means for exhausting air from a volume proximate the bowl, said intake means including a wall defining a chamber and having a plurality of intake apertures extending through said wall and into said chamber, said air intake means being mounted to said rim such that said wall is positioned alone an inner perimeter of said rim, and air extraction means coupled to said intake means for drawing in said air through said intake means, the improvement comprising:

fluid removal means defined by said intake means for removing fluid collecting in said intake means during extraction of said air, said fluid removal means including a trough defined by said wall and having a slanted face positioned between said trough and each said aperture, said slanted face being sufficiently inclined downwardly toward said trough to cause said fluid entering said apertures to gravitate toward said trough for collective removal thereof; and infrared actuating means, operably coupled to said extraction means and activating of said ventilation apparatus upon sensing movement proximate said toilet assembly.

24. The toilet ventilation apparatus as defined in claim 23 wherein, said air intake means is integrally formed in said bowl.

* * * * *